United States Patent [19]

Knox

[11] 4,178,112

[45] Dec. 11, 1979

[54] PLAT-GARD LEG CLOSURE

[75] Inventor: Lloyd C. Knox, Duncan, Okla.

[73] Assignee: Halliburton Company, Duncan, Okla.

[21] Appl. No.: 914,467

[22] Filed: Jun. 12, 1978

[51] Int. Cl.[2] ..... E02D 5/52

[52] U.S. Cl. ..... 405/227; 138/89; 277/235 R; 405/224

[58] Field of Search ..... 405/225, 226, 227, 195; 285/229, DIG. 2; 277/235 R; 138/109, 89, 90

[56] References Cited

U.S. PATENT DOCUMENTS

| | | | |
|---|---|---|---|
| 2,998,986 | 9/1961 | Buono | 285/229 |
| 3,139,115 | 6/1964 | Bawcom et al. | 285/229 X |
| 3,191,950 | 6/1965 | Hiltner | 277/235 X |
| 3,305,251 | 2/1967 | Skinner | 285/229 |
| 3,533,241 | 10/1970 | Bowerman et al. | 405/227 X |

*Primary Examiner*—Dennis L. Taylor

*Attorney, Agent, or Firm*—John H. Tregoning; James R. Duzan

[57] ABSTRACT

A diaphragm for closing the bore of a tubular piling guide member and/or supporting leg member of a marine platform or similar structure, the diaphragm comprising reinforced elastic material bonded to a plurality of reinforcing members in the periphery of the diaphragm with the diaphragm being positively secured to the guide member and/or leg of the platform by means of two flat annular plates which have fasteners retaining the diaphragm therebetween via holes therein.

8 Claims, 3 Drawing Figures

PLAT-GARD LEG CLOSURE

This invention relates to an improved closure diaphragm for offshore platforms used in well drilling and production.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into the subterranean formations below the ocean floor to anchor the platform in position.

It is desirable during platform setting operations to exclude foreign material from the platform leg to prevent the annulus between the piling and platform leg from becoming contaminated with foreign material which would prevent filling of the annulus with cement or grout. Therefore, a closure structure which is easily severable when the piling is driven through the platform leg is used to seal the end of the platform leg during setting of the platform.

One type of prior art leg closure as illustrated in U.S. Pat. No. 3,533,241 comprises a circular diaphragm of reinforced elastic material having an annular reinforcing element of circular cross-sectional shape molded in the periphery of the diaphragm with the diaphragm being secured to the leg of the platform by means of two annular plates, each plate having an annular groove of semi-circular cross-sectional shape therein for confining the annular reinforcing element in the periphery of the diaphragm between the two annular plates. The semi-circular grooves in the two annular plates are of slightly less radial diameter than the periphery of the diaphragm having the reinforcing element therein to confine the diaphragm periphery between the two annular plates by slightly deforming it. The reinforcing plies in the diaphragm are alternately wrapped and bonded about the reinforcing element in the periphery of the diaphragm to form a bead of circular cross-sectional shape about the diaphragm periphery without the ends of the plies extending into the inner portion of the diaphragm.

While the leg closure illustrated in U.S. Pat. No. 3,533,241 is of simple construction, the leg closure requires the two annular plates have the semi-circular grooves machined therein, which for large diameters of leg closures can be difficult, and requires the plies having reinforcing cords therein to be alternately wrapped and bonded about the annular reinforcing member which can cause handling problems during molding of the leg closure.

Another type of leg closure as illustrated in U.S. Pat. No. 4,024,723 comprises a circular diaphragm of reinforced elastic material having an annular reinforcing element being of a teardrop cross-sectional shape molded in the periphery of the diaphragm and having a ring of downwardly facing cutter blades molded in the upper surface of the diaphragm to sever the diaphragm when a piling is driven therethrough with the diaphragm being secured to the leg of the platform by means of two annular plates with one plate having an annular groove therein for confining the annular reinforcing element in the periphery of the diaphragm between the two annular plates.

While the leg closure of U.S. Pat. No. 4,024,723 is relatively simple to construct, it requires the addition of cutter blades to be molded in the leg closure which offer resistance when driving the piling through the leg closure and requires the machining of a circular cross-sectional shaped groove in at least one of the two annular plates securing the diaphragm to the leg or sleeve.

In contrast to the prior art leg closures, the leg closure of the present invention comprises a diaphragm of reinforced elastic material bonded to a plurality of reinforcing members in the periphery of the diaphragm with the diaphragm being positively secured to the leg of the platform by means of two flat annular plates which have fasteners retaining the diaphragm therebetween via holes therein.

The advantages and the preferred embodiments of the present invention will be understood from the following specification taken in conjunction with the accompanying drawings wherein.

Figure 1:
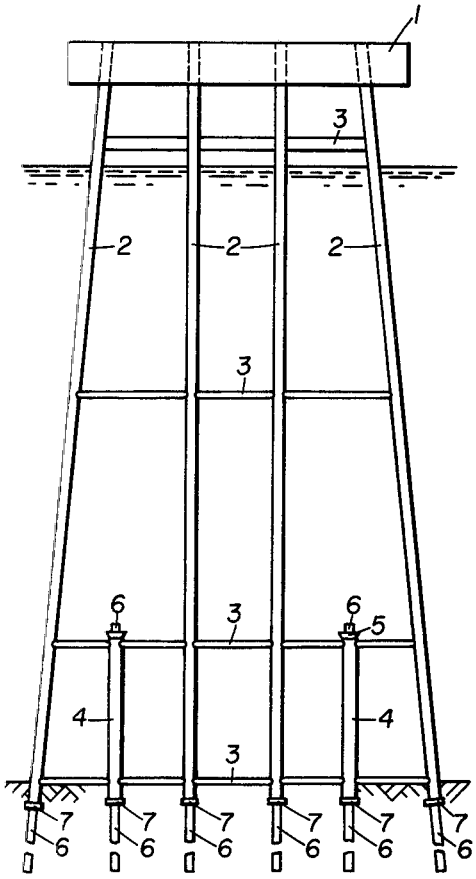
FIG. 1 is a side elevational view of a marine drilling platform having tubular supporting legs and piling guides between the legs resting on the bottom of a body of water with the present invention installed on the lower end of the legs and guides.

Referring to FIG. 1, the present invention is shown installed on a marine platform. A marine platform 1 having tubular supporting legs 2 between which horizontal reinforcing members 3 are connected in the usual manner. Tubular piling guides or piling sleeves 4, which may have flared upper ends 5, are supported between the lower end portion of the legs 2 by the lower reinforcing members 3 and, with the legs, are adapted to rest upon or have their lower extremities slightly embedded in the bottom of a body of water.

The guides 4 or legs 2 are secured to the earth by driving piling 6 to refusal into the bottom of the body of water. Upon completion of the pile driving, the annulus between each guide 4 and/or leg 2 and its associated piling 6 may be filled with cement or grout to provide a unitary base structure.

Contained on the bottom of each leg 2 and guide sleeve 4 is a rupturable seal assembly 7 which embodies the principles of the present invention.

Figure 2:
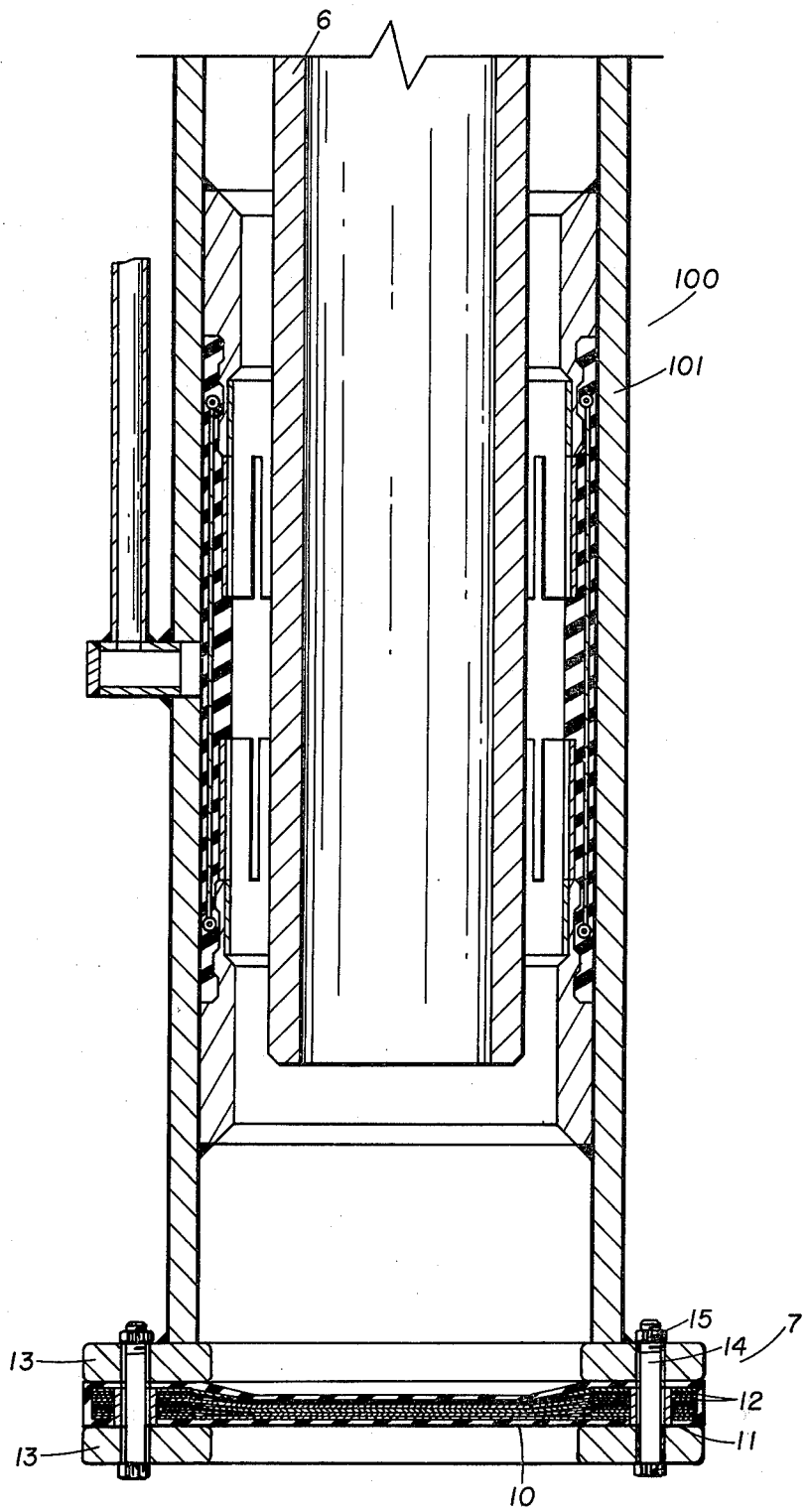
FIG. 2 is a cross-sectional view of the present invention in a typical installation in a leg or guide.

Referring to FIG. 2, the seal assembly 7 is shown in relation to an inflatable packer assembly 100 installed at the bottom of a leg 2 or guide 4. As shown, the diaphragm 10 is relatively thin compared to its diameter and has in its periphery 11 metal reinforcing members 12.

For mounting the seal assembly 7 on the lower end of the inflatable packer assembly 100, a pair of flat annular plates 13 is provided which are adapted to be detachably connected about their outer periphery by a plurality of bolts 14 and nuts 15. The upper annular plate 13 is adapted to be secured to the lower end of the packer housing 101 by welding, although any suitable means of securing the plate 13 may be used. If no inflatable packer is attached to the bottom of the leg 2 or guide 4, alternately, the plate 13 may be secured to the bottom of the leg 2 or guide 4.

As shown, the seal assembly closes the lower end of the inflatable packer assembly 100 which is secured to a leg 2 or guide 4 through which piling is to be driven to facilitate floating of the platform to its point of installation as well as prevent entrance of silt and other debris into the leg 2 or guide 4 during installation of the platform. To position the platform leg 2 and guide 4 on the bottom of the body of water, it is necessary to water flood some or all of the legs 2 and guides 4. After rupturing the diaphragm 10 by the piling 6 being driven into the bottom, the diaphragm 10 and the water located thereabove acts to help prevent entry of foreign material into the leg 2 or guide 4, although during driving of the piling 6 an amount of foreign material will be introduced into the leg 2 or guide 4.

Figure 3:
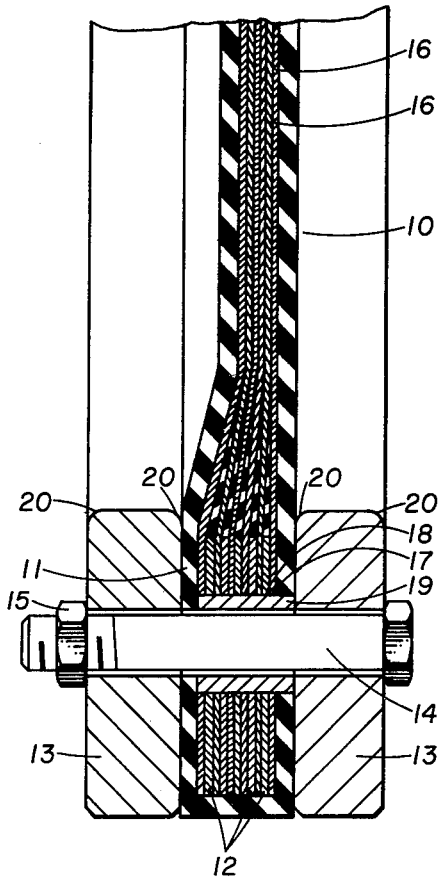
FIG. 3 is an enlarged broken, cross-sectional view of a preferred embodiment of the present invention.

Referring to FIG. 3, a preferred embodiment of the diaphragm 10 is shown. The diaphragm 10 comprises a flexible member of rubber, synthetic rubber or other suitable elastomeric material. To reinforce the diaphragm 10 a plurality of layers 16 of fabric are bonded in the diaphragm 10 with the periphery of the layers 16 of fabric being bonded to metal reinforcing members 12. Any number of layers of fabric may be used to reinforce the diaphragm 10 depending upon the desired strength of the diaphragm, although six (6) layers 16 of fabric are shown. The layers 16 of fabric used to reinforce the diaphragm 10 may be of any suitable material, such as rayon, nylon, steel, a fabric sold under the trademark of Kevlar by the DuPont Company, etc., although nylon is preferred.

The metal reinforcing members 12 are formed having a generally rectangular cross-sectional configuration. The metal reinforcing members 12 may be of any desired cross-sectional thickness and cross-sectional width depending upon the amount of bonding area to be exposed to the layers 16 of fabric used to reinforce the diaphragm 10 and the desired buckling strength of the members 12. Although any number of metal reinforcing members 12 may be used in the periphery 11 of the diaphragm 10, it is preferable to use a metal reinforcing member 12 between each layer 16 of fabric. As shown, for convenience in manufacturing five (5) metal reinforcing members 12 are interposed between the six (6) layers 16 of fabric in the diaphragm 10, although seven (7) or three (3) members 12 could be used if so desired, depending upon the desired strength of the diaphragm 10.

Also present in the periphery 11 of the diaphragm 10 are a plurality of bushings 19 which extend through apertures 17 in the layers 16 of fabric and apertures 18 in the metal reinforcing members 12. The bushings 19 are used to provide apertures through which the bolts 14 are passed thereby eliminating the drilling of the apertures for the bolts 14 in the diaphragm 10. However, if desired, the bushings 19 may be elminated, and the apertures for the bolts 14 merely drilled in the periphery 11 of the diaphragm 10.

The diaphragm 10 is positively retained by bolts 14 and nuts 15 between annular flat plates 13. The annular flat plates 13 may be formed having any desired cross-sectional thickness and cross-sectional width provided that the cross-sectional width is at least as great as the cross-sectional width of the metal reinforcing members 12 in the periphery 11 of the diaphragm 10. The inner edges 20 of the annular flat plates 13 are radiused to provide a smooth bearing surface for the inner portion of the periphery 11 of the diaphragm 10 to contact when loaded. The annular flat plates 13 may be formed of any material, such as steel, having sufficient strength to withstand the loading placed on it by the diaphragm 10 and which allows the plates 13 to be readily secured to the packer housing 101, such as by welding.

It should be noted that the diaphragm 10 is formed having the periphery 11 being thicker than the inner portion thereof to facilitate the driving of piling therethrough. Although the diaphragm 10 could be formed of constant thickness, the excess amount of elastic material in the inner portion of the diaphragm would offer increased resistance to the driving of a piling therethrough.

From the foregoing it should be readily apparent that the present invention offers important advantages over the prior art.

The diaphragm is easily constructed using simple bonding techniques without requiring the wrapping of reinforcing material about the metal reinforcing members.

The annular flat plates retaining the diaphragm have simple shapes requiring little machining for use.

The diaphragm is positively retained between the annular flat plates to prevent release therefrom.

The metal reinforcing members in the periphery of the diaphragm are simple geometric shapes which can be easily constructed.

The diaphragm is of a reinforced type capable of withstanding relatively high pressures over relatively large areas while remaining readily frangible by a piling driven therethrough without requiring the addition of cutting members in the diaphragm.

Having thus described my invention, I claim:

1. In combination, a diaphragm and annular diaphragm retaining means retaining said diaphragm therein, for closing the bore of a tubular support member of a marine platform or similar structure, said diaphragm comprising:

circular elastomeric flexible member means having a peripheral portion and an inner portion, the upper and lower exterior surfaces of the peripheral portion being substantially parallel to the upper and lower exterior surfaces of the inner portion; the cross-sectional thickness of said circular elastomeric flexible member means being substantially less in comparison than the diameter of said circular elastomeric flexible member means whereby the shape of said circular elastomeric flexible member means substantially comprises a disk;

a plurality of annular reinforcing member means located in the peripheral portion of said circular elastomeric flexible member means, each annular reinforcing member means of said plurality having a substantially rectangular cross-sectional shape with the cross-sectional thickness thereof being substantially less in comparison than the cross-sectional width thereof thereby forming a thin cross-sectional shape and each annular reinforcing member means of said plurality being disposed in the peripheral portion of said circular elastomeric flexible member means having the cross-sectional width thereof in substantially parallel relationship to the cross-sectional width of an adjacent annular reinforcing member means of said plurality and being disposed in substantially parallel relationship to the upper and lower exterior surfaces of the peripheral portion of said circular elastomeric flexible member means; and reinforcing means having a peripheral portion and an inner portion disposed within said flexible member means, said reinforcing means comprising a plurality of layers of fabric, each layer of fabric of said plurality having the peripheral portion thereof secured to the cross-sectional width of at least one of said annular reinforcing member means whereby each layer of fabric of said plurality is disposed within said circular elastomeric flexible member means in substantially parallel relationship with respect to an adjacent layer of fabric of said plurality; and said annular diaphragm retaining means comprising:

a pair of annular plate means releasably secured to each other by a plurality of fastening means extending through the pair of annular reinforcing member means, and through the peripheral portion of said reinforcing means, said annular diaphragm retaining means having one of the pair of annular plate means secured to the bottom of said tubular support member of a marine platform or similar structure thereby closing the bore of said tubular support member by said diaphragm and said diaphragm retaining means being installed thereon whereby the upper and lower surfaces of the peripheral portion of said circular elastomeric flexible member means sealingly engage such annular plate means of the pair of annular plate means throughout substantially one surface thereof by abutting the peripheral portion of said circular elastomeric flexible member means, the removal of the peripheral portion of said reinforcing means from the peripheral portion of said circular elastomeric flexible member means being prevented by the plurality of annular reinforcing member means secured thereto in substantially parallel relationship and the removal of the plurality of annular reinforcing member means from the peripheral portion of said circular elastomeric flexible member means being prevented by the plurality of fastening means extending therethrough.

2. The combination of claim 1 wherein said circular elastomeric flexible member means comprises rubber.

3. The combination of claim 1 wherein said circular elastomeric flexible member means comprises synthetic rubber.

4. The combination of claim 1 wherein said reinforcing means comprises a plurality of layers of nylon fabric.

5. The combination of claim 1 wherein said reinforcing means comprises a plurality of layers of rayon fabric.

6. The combination of claim 1 wherein said reinforcing means comprises a plurality of layers of steel fabric.

7. The combination of claim 1 wherein said reinforcing means comprises a plurality of layers of Kevlar fabric.

8. The combination of claim 1 wherein said plurality of annular reinforcing member means further comprises:

each annular reinforcing member means of said plurality having a plurality of apertures located therein; and a plurality of bushing means installed in the plurality of apertures in said plurality of annular reinforcing member means.

* * * * *

UNITED STATES PATENT AND TRADEMARK OFFICE

CERTIFICATE OF CORRECTION

PATENT NO. : 4,178,112

DATED : Dec. 11, 1979

INVENTOR(S) : Lloyd C. Knox

It is certified that error appears in the above-identified patent and that said Letters Patent are hereby corrected as shown below:

Column 5, Claim 1, line 8, the word "pair" should be corrected to read --plurality--.

Signed and Sealed this

*Third* Day of *June 1980*

[SEAL]

*Attest:*

SIDNEY A. DIAMOND

*Attesting Officer*

*Commissioner of Patents and Trademarks*